US006634854B1

(12) United States Patent
Albrecht et al.

(10) Patent No.: US 6,634,854 B1
(45) Date of Patent: Oct. 21, 2003

(54) MACHINERY UNIT WITH INTEGRATED HEAT BARRIER

(75) Inventors: Ludwig Albrecht, Ottensoos (DE); Horst Schreyer, Hersbrucl (DE)

(73) Assignee: KSB Aktiengesellschaft, Frankenthal (DE)

( * ) Notice: Subject to any disclaimer, the term of this patent is extended or adjusted under 35 U.S.C. 154(b) by 0 days.

(21) Appl. No.: 09/081,765

(22) Filed: May 21, 1998

(30) Foreign Application Priority Data

May 21, 1997 (DE) ..... 197 21 196

(51) Int. Cl.[7] ..... F04D 29/58
(52) U.S. Cl. ..... 415/178; 415/214.1; 417/373
(58) Field of Search ..... 165/135; 417/373; 415/123, 122.1, 134, 135, 175, 177, 178, 214.1

(56) References Cited

U.S. PATENT DOCUMENTS 3,572,982 A * 3/1971 Kozdon ..... 417/423
3,826,589 A * 7/1974 Frank et al. ..... 415/170 A
3,947,154 A * 3/1976 Klepp et al. ..... 417/373
4,120,618 A * 10/1978 Klaus ..... 417/420
4,239,462 A * 12/1980 Dach et al. ..... 417/373
4,720,248 A * 1/1988 Dernedde et al. ..... 417/373
4,775,291 A * 10/1988 Culbertson et al. ..... 415/104
5,624,245 A * 4/1997 DeClerck et al. ..... 417/373
5,626,460 A 5/1997 Franke et al.

FOREIGN PATENT DOCUMENTS

EP 0 731 280 9/1996

* cited by examiner

*Primary Examiner*—Ninh H. Nguyen
(74) *Attorney, Agent, or Firm*—Crowell & Moring LLP

(57) ABSTRACT

A machinery unit with a heat barrier which separates a part that is hot during operation from a cool part of the machinery unit. The machinery unit includes a fastening mechanism for holding the two parts together and at least one or more force-transmitting elements for producing a flux of force between the two parts. The present invention results in a less complicated, compact heat barrier due to the fact that the hot part and the cool part includes flange-like plates which are disposed adjacent one another at a spaced distance apart. The plates are joined together by one or more force-transmitting metal elements and the junction is made through a minimal cross-sectional area sufficient for the transmission force.

12 Claims, 2 Drawing Sheets

MACHINERY UNIT WITH INTEGRATED HEAT BARRIER

BACKGROUND OF THE INVENTION

This invention relates to a machinery unit with an heat barrier which separates a part that is hot during operation from a cool part of the machinery unit, while fastening means hold the two parts together and a flux of force is created between these parts through one or more force transmitting elements.

Published European Patent Application No. EP 731,280 discloses a unit of this type equipped with a heat barrier. This is a circulating pump unit for pumping hot fluids. The heat barrier serves to create a separation between the hot pump part and the parts of the unit which serve to seal and drive the pump. Such parts include, for example, the shaft seal and the rolling bearings; however, they might also comprise be the inner part of a magnetic clutch or of a gap tube motor in designs using no shaft seals.

While up to that time the overall length of the machinery unit had been increased by a considerable amount by a heat barrier, EP 731,280 achieved a definite reduction of the necessary axial length. This was achieved by the fact that, between the two parts of the unit, there is a rectilinear flux of force, this force flux passing through an insulating ceramic element or through a plurality of ceramic elements uniformly distributed about the circumference. Ceramic elements not only have the disadvantage of high price but also the disadvantage of their great mechanical frailty which requires special care and involves greater costs in handling.

SUMMARY OF THE INVENTION

It is the object of this invention to provide a machinery unit equipped with a heat barrier, which can be manufactured with the same axial length as a corresponding standardized machinery unit without a thermal barrier, but which avoids the need to use fragile and/or expensive materials.

Setting out from a machinery unit of the kind described above, the object is achieved according to the invention in that the hot part and the cool part have flange-like plates arranged adjacent to and spaced apart from one another, which are joined together via one or more force-transmitting metal elements, with the connection being made within a minimal cross-sectional area that is sufficient for the transmission of the force.

The force transmission which takes place through metal elements at first appears much less desirable than force transmission through ceramic elements which have a substantially lower thermal conductivity than metal. But since a metal element having only a small wall thickness is capable of transmitting comparatively great forces, the cross-sectional area available for thermal conduction can be kept substantially smaller with metal elements than it can in ceramic elements.

Due to the circumstance that, when metal is used, very strong walls can be made with very little thickness, configurations of the force-transmitting elements are possible which could not be achieved with ceramic. For example, profile bodies distributed over the circumference can be used which, unlike solid bodies made of ceramic, can also be made hollow. Likewise, one or more annular bodies made with relatively thin walls can serve as force-transmitting elements.

In the case of units held together by screws or bolts, it is especially advantageous if sleeves are used which surround the screws or bolts and have their ends in contact with the plates. But sleeves can also be used which extend into bores in the plates and are welded to the plates during assembly of the machinery unit. These have the additional advantage that manipulation that might cause any misalignment in the area of the thermal barrier can be largely avoided.

Different kinds of the possible force-transmitting elements can also be used in combination with each other.

The use of metal for the force-transmitting elements not only permits the use of elements which are independent of the plates, for example elements made of a material having a poor thermal conductivity, but also makes it possible to configure the force transmitting elements in one piece with one of the two plates.

If the two parts of the machinery unit that are joined together through the thermal barrier have a shaft passing through them, then it is recommended to connect the two plates together with a tubular body which surrounds and is spaced a slight distance from the shaft or a sleeve enclosing the shaft. In this case it is advantageous if the tubular body is joined in a pressure-tight and gas-tight manner to the plates. This can be achieved primarily by forming the tubular body on one of the two plates and welding it to the other plate.

It is furthermore recommendable to fill the space formed between the plates with a thermal insulating material.

Finally, it is also proposed to provide, in one or both plates, one or more annular cut-outs or recesses to accommodate force-transmitting elements and/or thermal insulating material. Such a measure serves primarily to shorten the axial length of the unit.

BRIEF DESCRIPTION OF THE DRAWINGS

The invention will be explained in further detail hereinafter with reference to illustrative preferred embodiments shown in the accompanying drawings, in which.

DETAILED DESCRIPTION OF PREFERRED EMBODIMENTS

Figure 1:
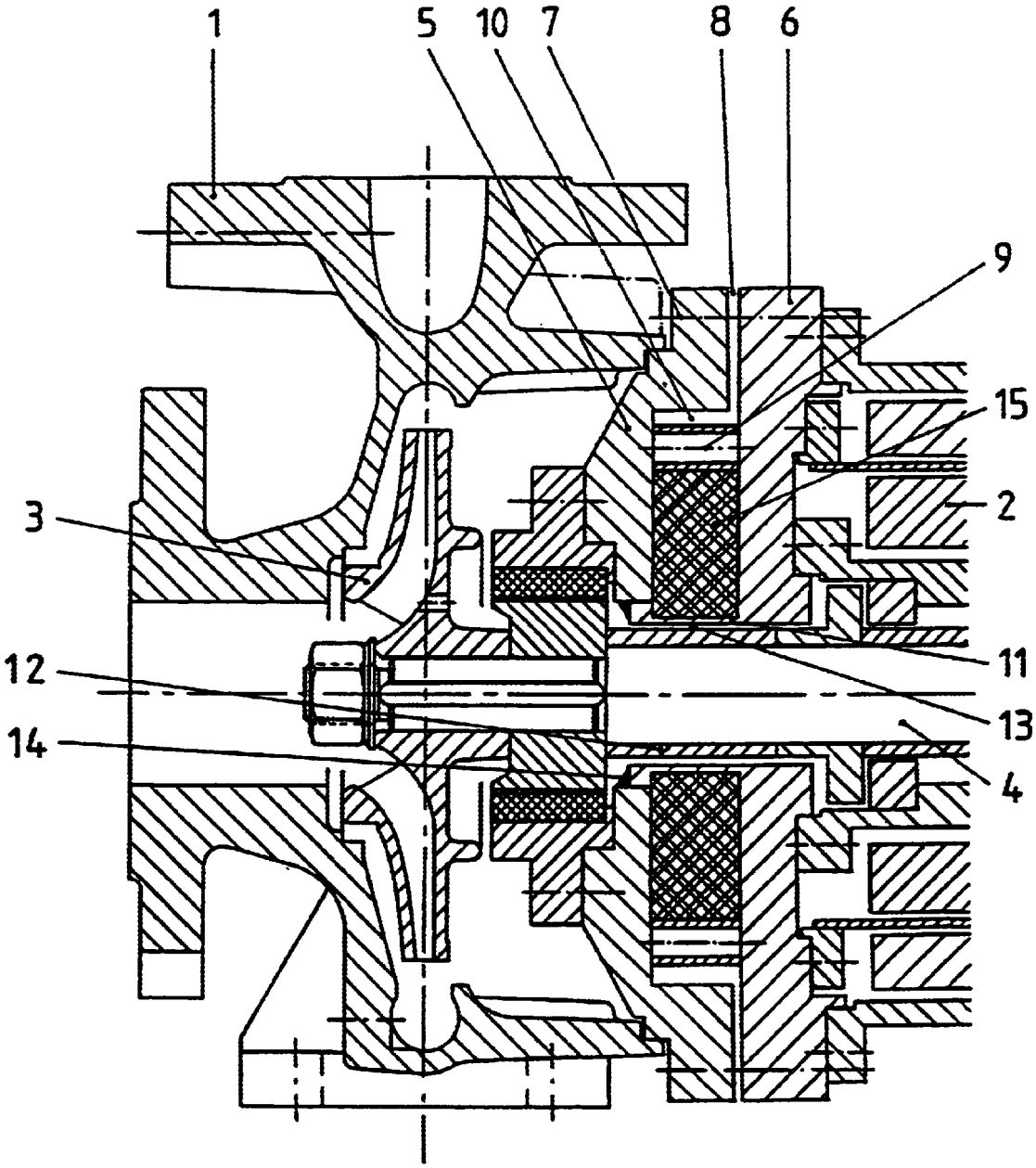
FIG. 1 is a sectional view of a machinery unit configured according to the invention.

The machinery unit shown in FIG. 1 is a circulation pump 1 which is driven through a magnetic clutch 2 of which only a small portion is shown. The impeller 3 of the circulation pump 1 is thus joined by a common shaft 4 with the secondary part of the magnetic clutch 2.

During operation of the circulation pump unit, the housing of the pump 1 is strongly heated by the hot fluid which is pumped by the pump. To prevent damage to the magnetic clutch 2, the latter has to be extensively protected against the heat. This is achieved by means of a thermal barrier disposed between the circulation pump 1 and the magnetic clutch 2.

The thermal barrier is formed between the cover 5 on the pressure side of the circulation pump 1 and the cover 6 of the housing of the magnetic clutch 2, which covers are both constructed in the form of flange-like plates. By means of a plurality of screws 7—merely indicated here—which are distributed uniformly about the circumference, the circulation pump 1 and the magnetic clutch 2 are joined together such that a narrow gap 8 is left between the cover 5 on the discharge side of the pump and clutch housing cover 6.

A plurality of profile bodies 9, which are distributed uniformly about the circumference, serve to transfer the force exerted by the screws 7 and are arranged in an annular recess 10 in cover 5 with their ends in contact with the cover 5 of the circulation pump 1 and the housing cover 6 of the magnetic clutch 2. The profile bodies 9 have a hollow construction, so as to have a relatively small cross-sectional area in contact with the covers 5 and 6.

The cover 6 of the housing of magnetic clutch 2 has a tubular body 11 formed on its inner side, which surrounds and is spaced a short distance 13 from a sleeve 12, which in turn encloses the shaft 4. Tubular body 11 extends into a correspondingly sized recess 14 in the cover 5 on the pressure side of the circulation pump 1. In order to produce a pressure-tight and gas-tight joint, the tubular body 11 is welded to the cover 5 within the recess 14.

A thermal insulating material 15 is used in the space formed between the covers 5 and 6.

Figure 2:
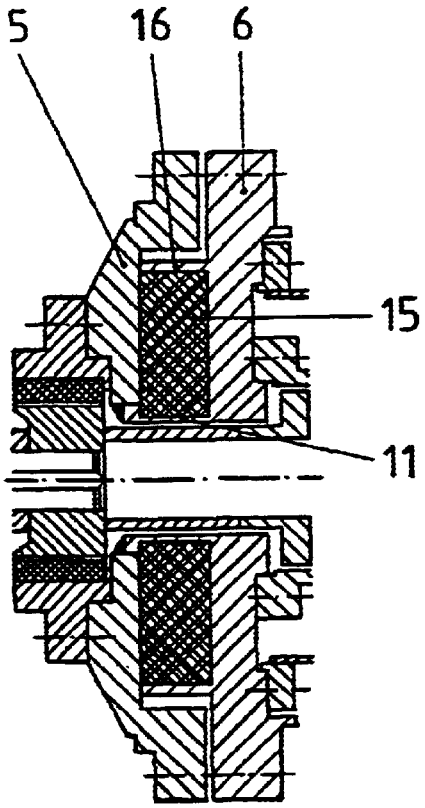
FIG. 2 is a partial view of a machinery unit corresponding to FIG. 1 with an alternative configuration in the area of the heat barrier.

The thermal barrier illustrated in FIG. 2 differs from the thermal barrier of FIG. 1 primarily in that, instead of a plurality of individual force-transmitting elements 9, only a single annular element 16 is used, which is formed in one piece with the cover 6 of the magnetic clutch 2. This annular element 16 also has only a small overall cross-sectional area at which it comes into contact with the discharge-side cover 5 of the circulation pump 1. Consequently, in this embodiment there likewise exists only a small area for heat transmission.

Figure 3:
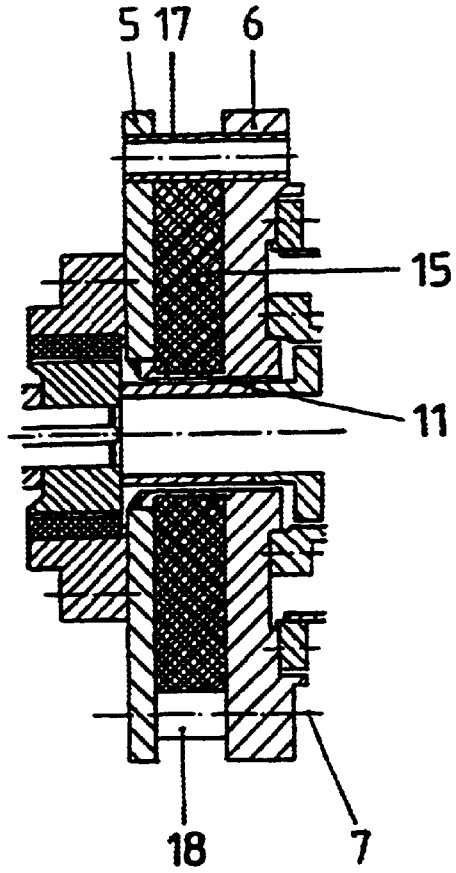
FIG. 3 is a partial view showing two more alternative configurations in the area of the heat barrier.

The upper half of FIG. 3 shows an embodiment which uses as force-transmitting elements sleeves 17 which surround the screws 7 (not shown here) which connect the circulation pump 1 to the magnetic clutch 2. The sleeves 17 are each welded to the discharge-side cover 5 of the circulation pump 1 and to the cover 6 of the housing of the magnetic clutch 2. After the step-by-step assembly and welding of the parts forming the heat barrier, the sleeve 17 is to be machined so as to form a flat surface with the surface of cover 5 facing the circulation pump 1.

In the embodiment shown in the lower part of FIG. 3, a sleeve 18 is used which has a larger diameter than the bores provided for the screw 7 and which lies with its ends supported against the covers 5 and 6. Thus, the force in this case is likewise transferred to a small total area in the immediate vicinity of the screw creating the force.

The various embodiments of a circulation pump driven through a magnetic clutch depicted here as examples of the invention, can also be applied in circulation pumps which are connected to other kinds of drives. An example is a circulation pump powered by a gap tube motor, in which the thermal barrier can be configured very similarly to the embodiments described above. Basically, the design of the invention can be used in all machinery units in which a separation must be maintained between a hot part and a part that must be protected against heat.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A machinery unit comprising a hot part, a cool part, a heat barrier which separates the hot part from the cool part, a fastener for holding said hot and cool parts together, and at least one force-transmitting metal element for producing a flux of force between the hot and cool parts, wherein the hot part and the cool part have flange-like plates disposed adjacent one another and spaced apart from one another, said flange-like plates being joined together by said at least one force-transmitting element through a minimal cross-sectional surface sufficient for the transmission of said force, and wherein a shaft passes through the hot and cool parts, and said flange-like plates are joined together by an annular body which surrounds and is spaced a slight distance away from the shaft or a sleeve enclosing the shaft.

2. A machinery unit according to claim 1, wherein said annular body is joined to said flange-like plates with pressure-tight and gas-tight joints.

3. A machinery unit according to claim 2, wherein said annular body is formed integrally on one of the flange-like plates and is welded to the other flange-like plate.

4. A machinery unit according to claim 1 comprising a hot part, a cool part, a heat barrier which separates the hot part from the cool part, a fastener for holding said hot and cool parts together, and at least one force-transmitting metal element for producing a flux of force between the hot and cool parts, wherein the hot part and the cool part each include a cover or housing formed by a flange-like plate, said flange-like plates being disposed adjacent one another and spaced apart from one another and being joined together by said at least one force-transmitting element through a minimal cross-sectional surface sufficient for the transmission of said force; wherein a thermal insulating material fills a space between the adjacent flange-like plates, and wherein each said at least one force transmitting element is a separate part independent of the flange-like plates.

5. A machinery unit according to claim 4, wherein each said at least one force transmitting element is made from a metal having a low heat conductivity.

6. A machinery unit according to claim 4, wherein the force transmitting elements comprise a plurality of profile bodies distributed uniformly around the periphery of the flange-like plates.

7. A machinery unit according to claim 4, wherein each of the force transmitting elements comprises an annular body.

8. A machinery unit according to claim 4, wherein said fastener comprises screws or bolts which hold together the two parts of the machinery unit, and said force-transmitting element comprises sleeves which surround each said fastener and which have ends in contact with the flange-like plates.

9. A machinery unit comprising a hot part, a cool part, a heat barrier which separates the hot part from the cool part, a fastener for holding said hot and cool parts together, and at least one force-transmitting metal element for producing a flux of force between the hot and cool parts, wherein the hot part and the cool part have flange-like plates disposed adjacent one another and spaced apart from one another, said flange-like plates being joined together by said at least one force-transmitting element through a minimal cross-sectional surface sufficient for the transmission of said force; wherein each said at least one force transmitting element is made in one piece with one of the flange-like plates, and wherein the force transmitting elements comprise a plurality of profile bodies distributed uniformly around the periphery of the flange-like plates.

10. A machinery unit comprising a hot part, a cool part, a heat barrier which separates the hot part from the cool part, a fastener for holding said hot and cool parts together, and at least one force-transmitting metal element for producing a flux of force between the hot and cool parts, wherein the hot part and the cool part have flange-like plates disposed adjacent one another and spaced apart from one another said flange-like plates being joined together by said at least one force-transmitting element through a minimal cross-sectional surface sufficient for the transmission of said force; wherein each said at least one force transmitting element is made in one piece with one of the flange-like plates, and wherein said fastener comprises screws or bolts which hold together the two parts of the machinery unit, and said force-transmitting element comprises sleeves which surround each said fastener and which are welded to both of the flange-like plates.

11. A machinery unit comprising a hot part, a cool part, a heat barrier which separates the hot part from the cool part, a fastener for holding said hot and cool parts together, and at least one force-transmitting metal element for producing a flux of force between the hot and cool parts, wherein the hot part and the cool part have flange-like plates disposed adjacent one another and spaced apart from one another, said flange-like plates being joined together by said at least one force-transmitting element through a minimal cross-sectional surface sufficient for the transmission of said force, wherein each said at least one force transmitting element is a separate part independent of the flange-like plates, and wherein the force-transmitting elements comprise a combination of different force-transmitting elements.

12. A machinery unit comprising a hot part, a cool part, a heat barrier which separates the hot part from the cool part, fasteners for holding said hot and cool parts together, and at least one force-transmitting metal element for producing a flux of force between the hot and cool parts, wherein the hot part and the cool part have flange-like plates disposed adjacent one another and spaced apart from one another, said flange-like plates being joined together by said at least one force-transmitting element through a minimal cross-sectional surface sufficient for the transmission of said force, each force-transmitting element being a separate part independent of the flange-like plates, and wherein a thermal insulating material fills a space between the adjacent flange-like plates and the fasteners include screws or bolts which hold together the two parts of the machinery unit, and the at least one force-transmitting element includes a sleeve which surrounds each of the fasteners and includes ends which contact the flange-like plates.

* * * * *